US007571798B2

(12) United States Patent
Spatafora

(10) Patent No.: US 7,571,798 B2
(45) Date of Patent: Aug. 11, 2009

(54) METHOD AND DEVICE FOR CONTROLLED FILLING OF A FEED CHANNEL SUPPLYING TOBACCO ARTICLES

(75) Inventor: Mario Spatafora, Granarolo (IT)

(73) Assignee: G.D Societa per Azioni, Bologna (IT)

( * ) Notice: Subject to any disclaimer, the term of this patent is extended or adjusted under 35 U.S.C. 154(b) by 506 days.

(21) Appl. No.: 11/374,410

(22) Filed: Mar. 13, 2006

(65) Prior Publication Data

US 2006/0237336 A1 Oct. 26, 2006

(30) Foreign Application Priority Data

Mar. 24, 2005 (IT) ..... BO2005A/0186

(51) Int. Cl.
*B65G 1/00* (2006.01)

(52) U.S. Cl. ..... 198/347.2; 198/347.1; 53/236; 414/413

(58) Field of Classification Search ..... 198/347.1, 198/530, 347.2, 347.4; 53/236, 244; 414/413, 414/414

See application file for complete search history.

(56) References Cited

U.S. PATENT DOCUMENTS 3,137,110 A 6/1964 Boinnard
3,565,237 A * 2/1971 Strydom ..... 198/572
4,365,702 A * 12/1982 Tolasch et al. ..... 198/347.3
4,365,703 A 12/1982 Hinchcliffe et al.
4,744,453 A * 5/1988 Krause et al. ..... 198/347.2
5,217,101 A * 6/1993 Raschka ..... 198/347.2
5,529,164 A * 6/1996 Meinke et al. ..... 198/347.2
6,540,061 B1 4/2003 Focke et al.

FOREIGN PATENT DOCUMENTS

DE 684 851 12/1939
FR 1 502 715 11/1967

* cited by examiner

*Primary Examiner*—James R Bidwell
(74) *Attorney, Agent, or Firm*—Ladas & Parry LLP

(57) ABSTRACT

A method and device for controlled filling of a channel supplying tobacco articles, whereby a lead-in member is positioned inside the channel to completely cut off passage along the channel; a mass of tobacco articles is then fed into the channel so that the mass of tobacco articles is positioned contacting the lead-in member; and, finally, the lead-in member is eased along the channel, while keeping the mass of tobacco articles in contact with the lead-in member, to ease the mass of tobacco articles along the channel.

41 Claims, 9 Drawing Sheets

METHOD AND DEVICE FOR CONTROLLED FILLING OF A FEED CHANNEL SUPPLYING TOBACCO ARTICLES

TECHNICAL FIELD

The present invention relates to a method and device for controlled filling of a feed channel supplying tobacco articles.

The present invention may be used to particular advantage for filling a cigarette hopper on a cigarette packing machine, to which the following description refers purely by way of example.

BACKGROUND ART

A cigarette hopper comprises at least one substantially vertical channel, which receives the cigarettes from a top feed conduit and feeds them by force of gravity to a number of outlets at the bottom of the hopper, where a number of pushers expel groups of cigarettes cyclically from the outlets onto a packing line.

Depending on market demand, the same packing machine may be used to pack different types of cigarettes, normally differing in size (length and/or diameter) or in the characteristics of the tobacco or filter.

To switch over to a new type of cigarette (i.e. at each brand change), the hopper must be cleared of the old brand and filled with the new one. Filling of the hopper must be conducted in controlled manner, in the sense that the cigarettes must be placed inside the hopper in orderly manner and with no undue mechanical stress which might damage the cigarettes (particularly as a result of tobacco fallout from the tips). At present, the hopper is filled manually, i.e. by an operator starting from the bottom and working upwards until the hopper is almost full; and only then can the cigarettes be fed in from the top feed conduit.

Filling the hopper manually is an extremely slow job, obviously requiring the assistance of an operator, so that preparing the packing machine for a new brand involves considerable downtime.

Patent DE684851 describes the controlled filling of a cigarette box using a flexible belt which accompanies the cigarettes during the controlled filling of the cigarette box.

Patent US6540061B1 describes the controlled filling of a cigarette box or hopper. The cigarettes are fed by force of gravity and slide inside separate compartments. As they are fed in, the cigarettes are supported underneath by mechanical supports, which are eased downwards to gradually increase the volume of the compartments until a maximum volume is reached. On reaching the bottom of the box or hopper, the mechanical supports are moved horizontally out of the box or hopper and back up to the start position. In an alternative embodiment for filling a cigarette hopper, a guide member is positioned at the top of the hopper to intercept and support the incoming mass of cigarettes, and is then moved gradually to ease the cigarettes in, and eventually out of the hopper. The guide member is comb-shaped and is moved in and out of the hopper through a comb-shaped wall of the hopper.

Patent US5743067A1 describes a cigarette box filling device, wherein a cigarette hopper has an output opening defined by the outlets of a number of side by side channels for respective columns of cigarettes. The hopper has a box filling device having a horizontal plate for supporting an orderly mass of cigarettes, and which moves vertically along a box, positioned with its inlet facing the output opening, and has side by side seats on top for respective cigarettes. Each outlet faces a rib separating two respective adjacent seats on the plate, and the channels all slope the same way with respect to the plate.

Patent US4366895A1 describes a device for filling a cigarette box divided internally into channels by parallel vertical walls; and the device comprises a number of horizontal supporting members, each for supporting and easing the cigarettes downwards into a respective channel.

The filling devices described above all employ a supporting member for easing in the mass of cigarettes, and which is extracted from the channel once it is full. Since the cigarette feed channel must be sealed off as far as possible from the outside, to prevent uncontrolled escape of the tobacco powder inevitably produced by the cigarettes, extracting the supporting member from the channel once it is full poses various construction problems.

Moreover, the filling devices described above, by employing a large, heavy, rigid supporting member, are bulky and so call for high-performance (i.e. bulky, high-cost) actuators.

DISCLOSURE OF INVENTION

It is an object of the present invention to provide a method and device for controlled filling of a feed channel supplying tobacco articles, designed to eliminate the aforementioned drawbacks, and which at the same time are cheap and easy to implement.

According to the present invention, there are provided a method and device for controlled filling of a feed channel supplying tobacco articles, as recited in the attached Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 1:
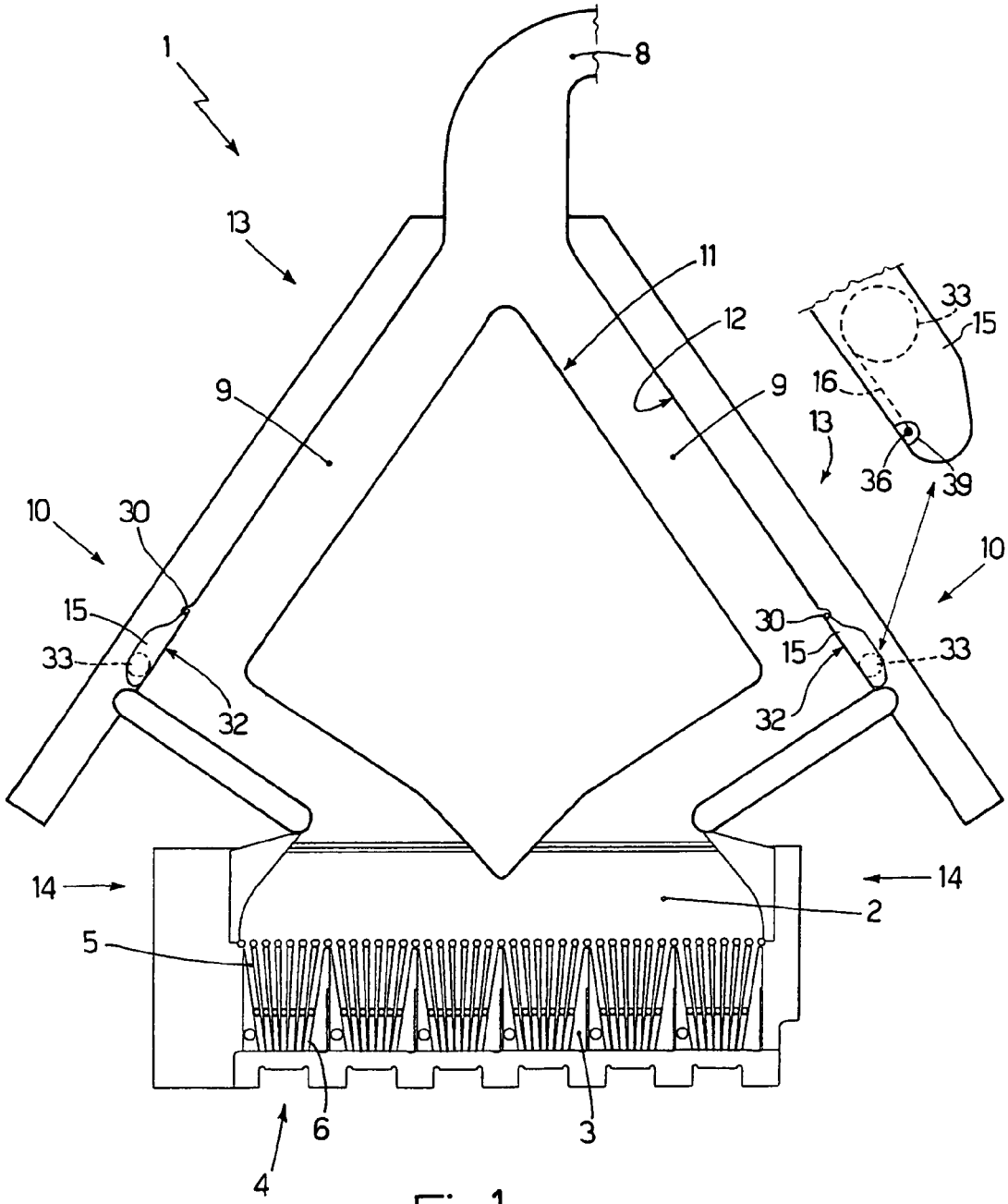
FIG. 1 shows a schematic front view of a cigarette hopper featuring a filling device in accordance with the present invention.

Number 1 in FIG. 1 indicates as a whole an empty cigarette hopper comprising a top chamber 2; and a bottom chamber 3, in which are defined a number of outlets 4 from which to expel groups of cigarettes from hopper 1. Bottom chamber 3 comprises a number of channels 5 bounded by fixed walls 6 and arranged into a number of groups, each associated with a respective outlet 4.

In actual use, hopper 1 is filled completely with cigarettes 7, which are fed from a top feed channel 8 and travel down hopper 1 by force of gravity. As the groups of cigarettes 7 are expelled from outlets 4, cigarettes 7 fall by gravity along hopper 1, and further cigarettes 7 are fed into hopper 1 from feed channel 8.

Top chamber 2 of hopper 1 is divided into two specular halves, each comprising a V-shaped channel 9 which comes out inside bottom chamber 3. More specifically, the two channels 9 have a common inlet at feed channel 8, and a common outlet at bottom chamber 3.

Hopper 1 comprises two filling devices 10, each fitted to a respective channel 9 to fill channel 9 gradually in controlled manner. More specifically, both channels 9 are filled simultaneously by respective filling devices 10.

Each channel 9 is bounded laterally by two opposite, facing walls 11 and 12, and is divided into an initial portion 13 and an end portion 14. Each filling device 10 comprises a rigid, non-deformable lead-in member 15 for gradually filling initial portion 13 of channel 9; and a flexible lead-in member 16 for gradually filling end portion 14 of channel 9.

Figure 2:
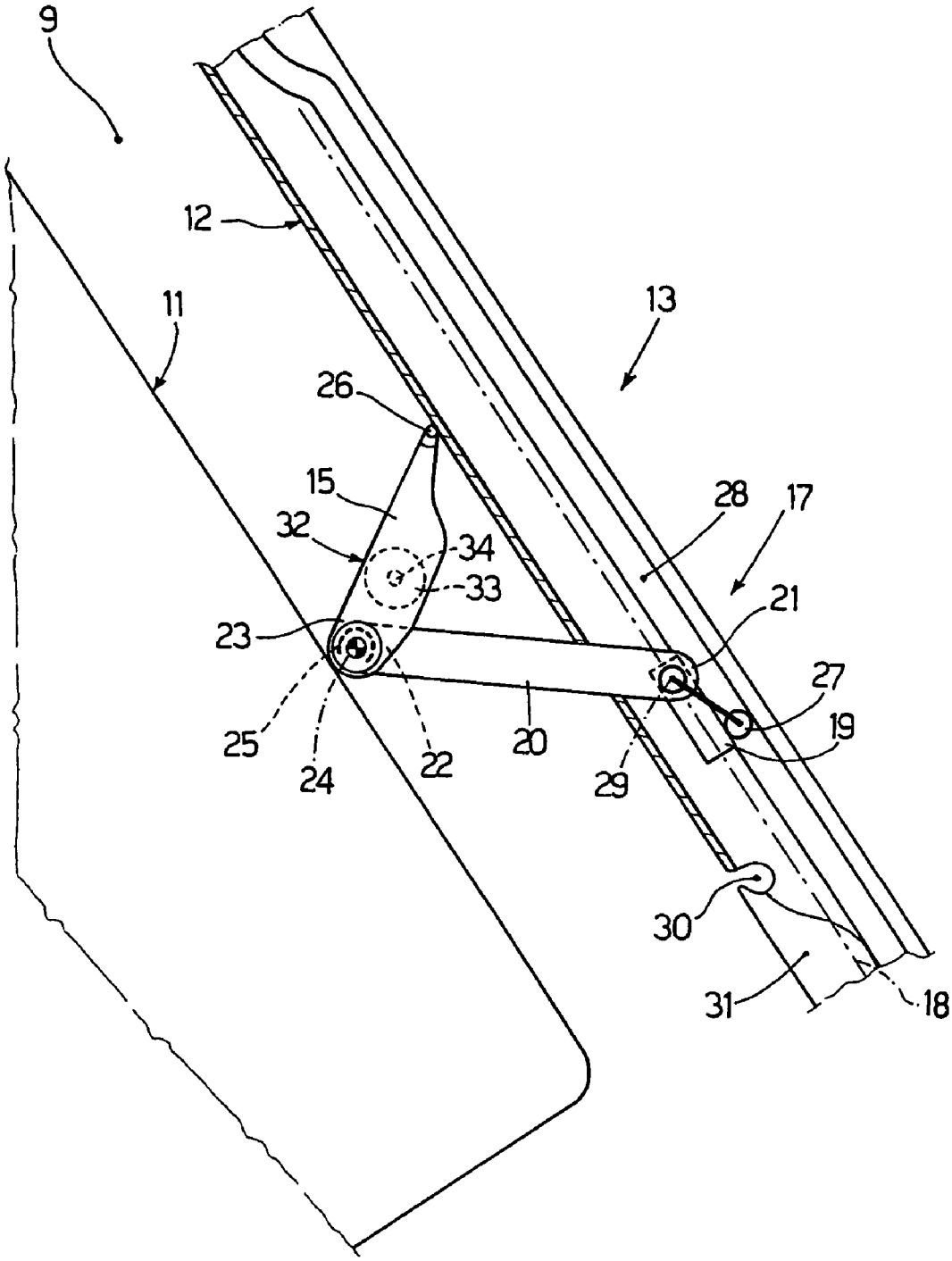
FIG. 2 shows a larger-scale detail of an actuating device of the FIG. 1 filling device.

As shown in FIG. 2, lead-in member 15 is larger than the distance between wall 11 and wall 12, is therefore tilted inside channel 9 to form non-right-angles with walls 11 and 12, and is connected to an actuating device 17 which, in use, eases lead-in member 15 along channel 9, substantially in contact with the inner surfaces of walls 11 and 12 bounding channel 9.

Actuating device 17 comprises a guide 18 extending parallel to and outside channel 9; and a carriage 19 which runs along guide 18 under the control of a known motor (not shown). Carriage 19 supports a rigid arm 20, in turn supporting lead-in member 15 and having one end 21 hinged to carriage 19, and an opposite end 22 hinged to one end 23 of lead-in member 15. End 23 of lead-in member 15 is hinged to arm 20 to allow lead-in member 15 to rotate freely about an axis of rotation 24 perpendicular to the FIG. 2 plane. End 21 of arm 20 is maintained close to wall 11 of channel 9, and arm 20 supports a spiral spring 25 which pushes one end 26, opposite end 23, of lead-in member 15 against wall 12 of channel 9 with a given elastic force. End 21 of arm 20 is hinged to carriage 19 to rotate, under the control of a tappet roller 27 fitted to a cam 28, about an axis of rotation 29 parallel to axis of rotation 24, so that, when carriage 19 runs along guide 18, arm 20 rotates about axis of rotation 29.

On wall 12 of channel 9 are formed a catch member 30; and a seat 31 for receiving lead-in member 15 and located immediately downstream from catch member 30. Seat 31 is a negative, in shape, of lead-in member 15, so that, when lead-in member 15 is housed inside seat 31, an outer surface 32 of lead-in member 15 is coplanar with wall 12. In actual use, the end of lead-in member 15 engages catch member 30 mechanically to insert lead-in member 15 inside seat 31.

Lead-in member 16 is flexible and normally wound into a reel 33 about a pin 34 fitted to lead-in member 15; one end 35 of lead-in member 16 is located inside reel 33, and one end 36, opposite end 35, of lead-in member 16 is substantially free and maintained close to end 23 of lead-in member 15.

In actual use, just before end 26 of lead-in member 15 mechanically engages catch member 30, end 36 of lead-in member 16 is fixed to wall 11. End 36 of lead-in member 16 may be fixed to wall 11 by means of a mechanical coupling; in which case, a hook along wall 11 engages an eye on end 36 of lead-in member 16. Alternatively, end 36 of lead-in member 16 may be fixed to wall 11 by a magnetic coupling; in which case, an electromagnet is located on wall 11 and activated to magnetically attract end 36 of lead-in member 16.

When lead-in member 15 rotates about catch member 30 into seat 31, lead-in member 16 unwinds partly off reel 33 and across channel 9 to completely cut off passage along channel 9. More specifically, end 36 of lead-in member 16 contacts wall 11, and end 35 of lead-in member 16 is located close to wall 12. At this point, an actuating device 37 unwinds reel 33 to gradually increase the length of lead-in member 16 inside channel 9 and so ease the mass of cigarettes 7 along channel 9. Actuating device 37 preferably comprises a motor 38, which is connectable to pin 34 to rotate pin 34 to wind or unwind reel 33.

Operation of filling devices 10 in FIG. 1 will now be described with particular reference to the successive filling stages shown in FIGS. 3 to 5.

In FIG. 1, hopper 1 is empty, with filling devices 10 set to a rest position, in which each lead-in member 16 is almost entirely wound into respective reel 33, each lead-in member 15 is housed inside respective seat 31, and end 36 of lead-in member 16 is located close to end 23 of lead-in member 15 and inside a seat 39 formed in wall 12 of lead-in member 15, so that an outer surface of end 36 is coplanar with a surface of wall 12.

Figure 3:
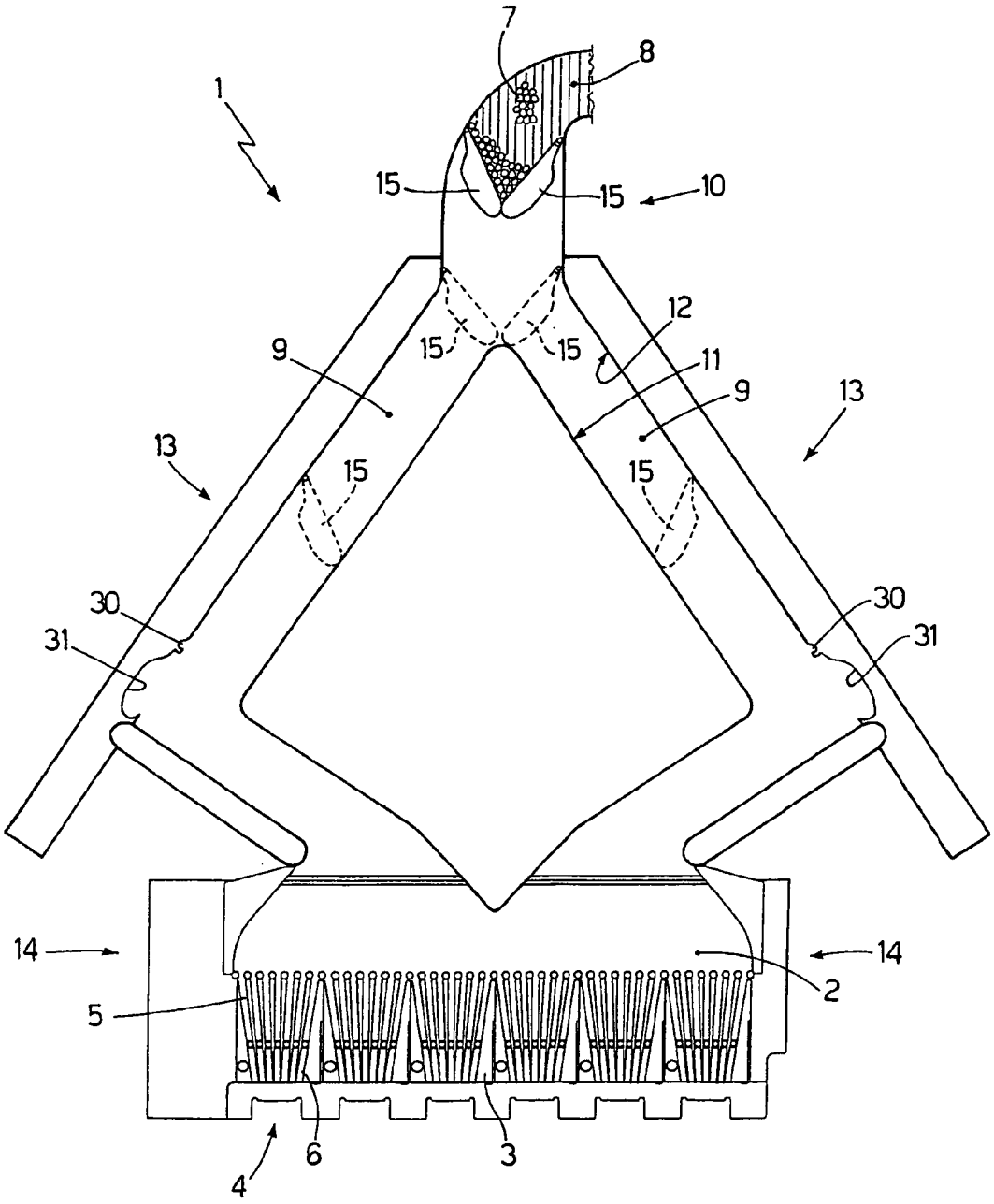
FIGS. 3 to 5 show front views of a channel of the FIG. 1 cigarette hopper at successive filling stages.

When commencing controlled automatic filling of hopper 1, filling devices 10 are activated and moved from the FIG. 1 rest position to a start position shown in FIG. 3. More specifically, the FIG. 3 start position is reached by operating each actuating device 17 to position each lead-in member 15 inside initial portion 13 of channel 9 and so completely cut off passage along channel 9. In a preferred embodiment, ends 23 of the two lead-in members 15 are positioned substantially contacting, so that the two lead-in members 15 form a "V".

At this point, a mass of cigarettes 7 is fed along feed channel 8 onto the two lead-in members 15. It is important to not that, hopper 1 being substantially vertical, cigarettes 7 are maintained on lead-in members 15 by force of gravity.

Figure 4:
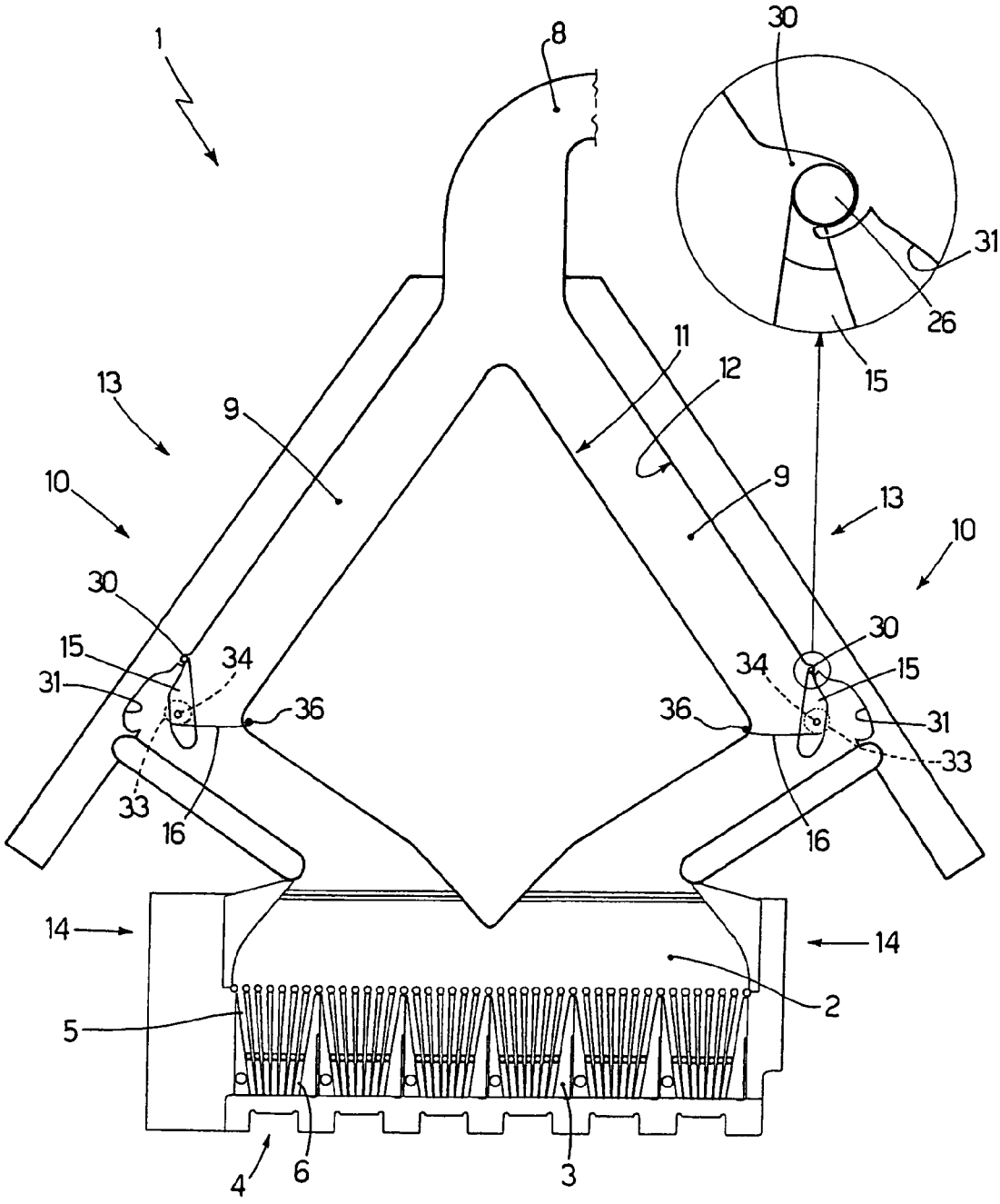
Figure 5:
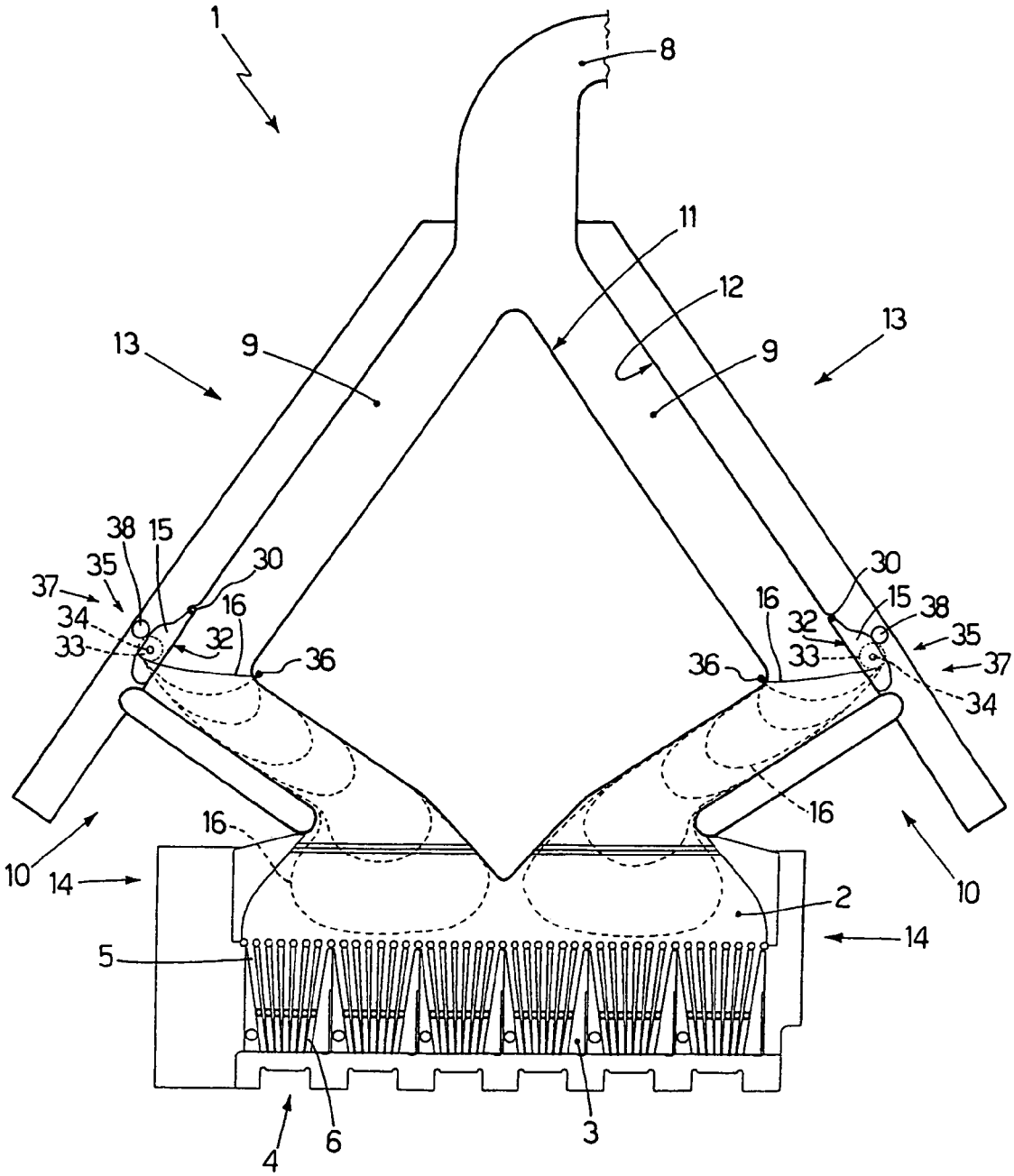

Once the mass of cigarettes 7 contacts the two lead-in members 15, each actuating device 17 is operated to ease lead-in member 15 along channel 9, substantially in contact with the inner surfaces of walls 11 and 12 bounding channel 9, as shown in FIG. 4, and so ease the mass of cigarettes 7 along channel 9.

At a certain point in the downward movement of each lead-in member 15 along channel 9, end 26 of lead-in member 15 mechanically engages and locks onto catch member 30 on wall 12, so that lead-in member 15 rotates about end 26 into seat 31 until the outer surface 32 of lead-in member 15 is coplanar with wall 12.

Just before end 26 of lead-in member 15 mechanically engages catch member 30, end 36 of lead-in member 16 is fixed to wall 11. As lead-in member 15 rotates about catch member 30 into seat 31, lead-in member 16 unwinds partly off reel 33 and across channel 9 to completely cut off passage along channel 9. More specifically, end 36 of lead-in member 16 contacts wall 11, and end 35 of lead-in member 16 is located close to wall 12. At this point, actuating device 37 unwinds reel 33 to gradually increase the length of lead-in member 16 inside channel 9 and so ease the mass of cigarettes 7 along channel 9. As the mass of cigarettes 7 is eased along channel 9, lead-in member 16 therefore defines, between ends 36 and 35, a flexible bag containing the mass of cigarettes 7 and resting on walls 11 and 12 bounding channel 9. In other words, by unwinding reel 33, actuating device 37 eases lead-in member 16 along channel 9.

Each lead-in member 16 is unwound off reel 33 until lead-in member 16 comes to rest on walls 6 of bottom chamber 3 of hopper 1; at which point, end 36 of lead-in member 16 is detached from wall 11, and lead-in member 16 is slowly rewound into reel 33 to clear channel 9 and allow cigarettes 7 to drop freely through hopper 1.

FIGS. 6 to 10 show an alternative embodiment of a cigarette hopper 1, wherein top chamber 2 comprises only one vertical channel 9. As such, hopper 1 in FIGS. 6 to 10 comprises only one filling device 10.

Figure 6:
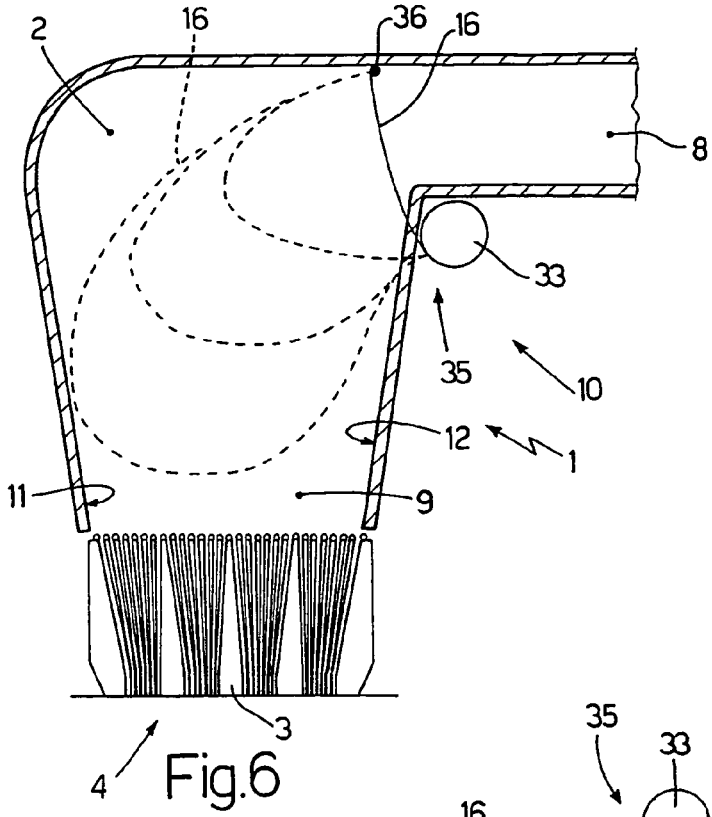
FIGS. 6 to 10 show front views of an alternative cigarette hopper featuring alternative embodiments of a filling device in accordance with the present invention.

In the FIG. 6 embodiment, filling device 10 has only one flexible lead-in member 16 identical to lead-in member 16 described above. In actual use, end 36 of lead-in member 16 is fixed to wall 11; end 35 of lead-in member 16 is located inside reel 33, close to wall 12; and ends 35 and 36 of lead-in member 16 are maintained in fixed positions, and the length of lead-in member 16 inside channel 9 is increased gradually by unwinding reel 33 to ease the mass of cigarettes 7 along channel 9.

Figure 7:
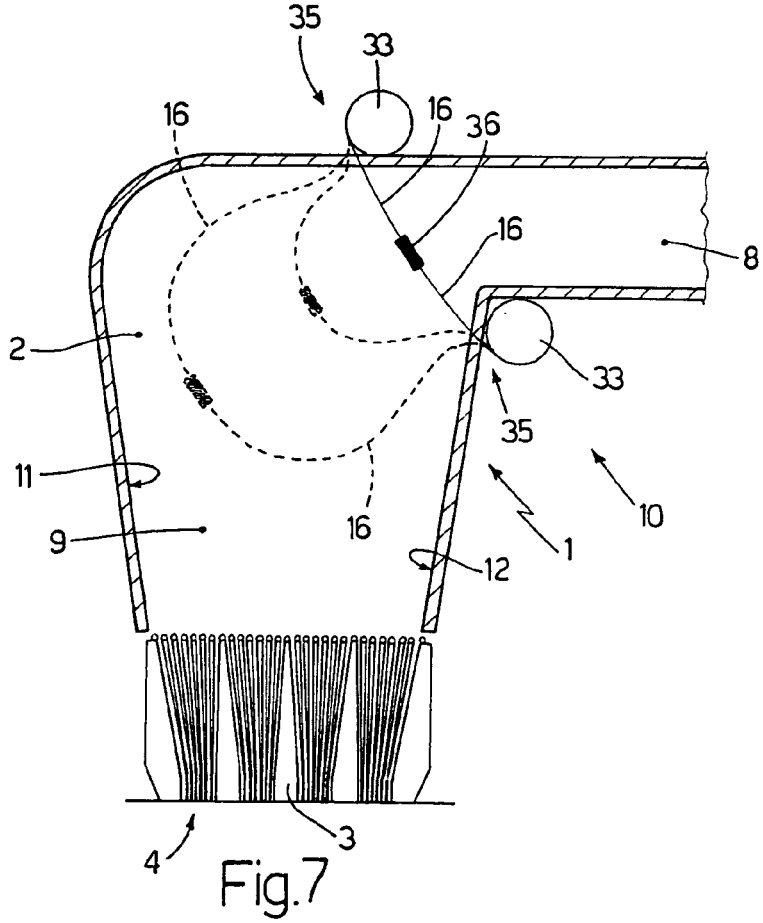

In the FIG. 7 embodiment, filling device 10 has two flexible lead-in members 16 identical to the lead-in member 16 described above. In actual use, the two lead-in members 16 are connected to each other at ends 36 to define a single flexible lead-in member 16; the length of lead-in member 16 is increased by unwinding both reels 33; and, at the end of the filling operation, the two lead-in members 16 are separated and gradually withdrawn from channel 9 by rewinding both reels 33.

Figure 8:
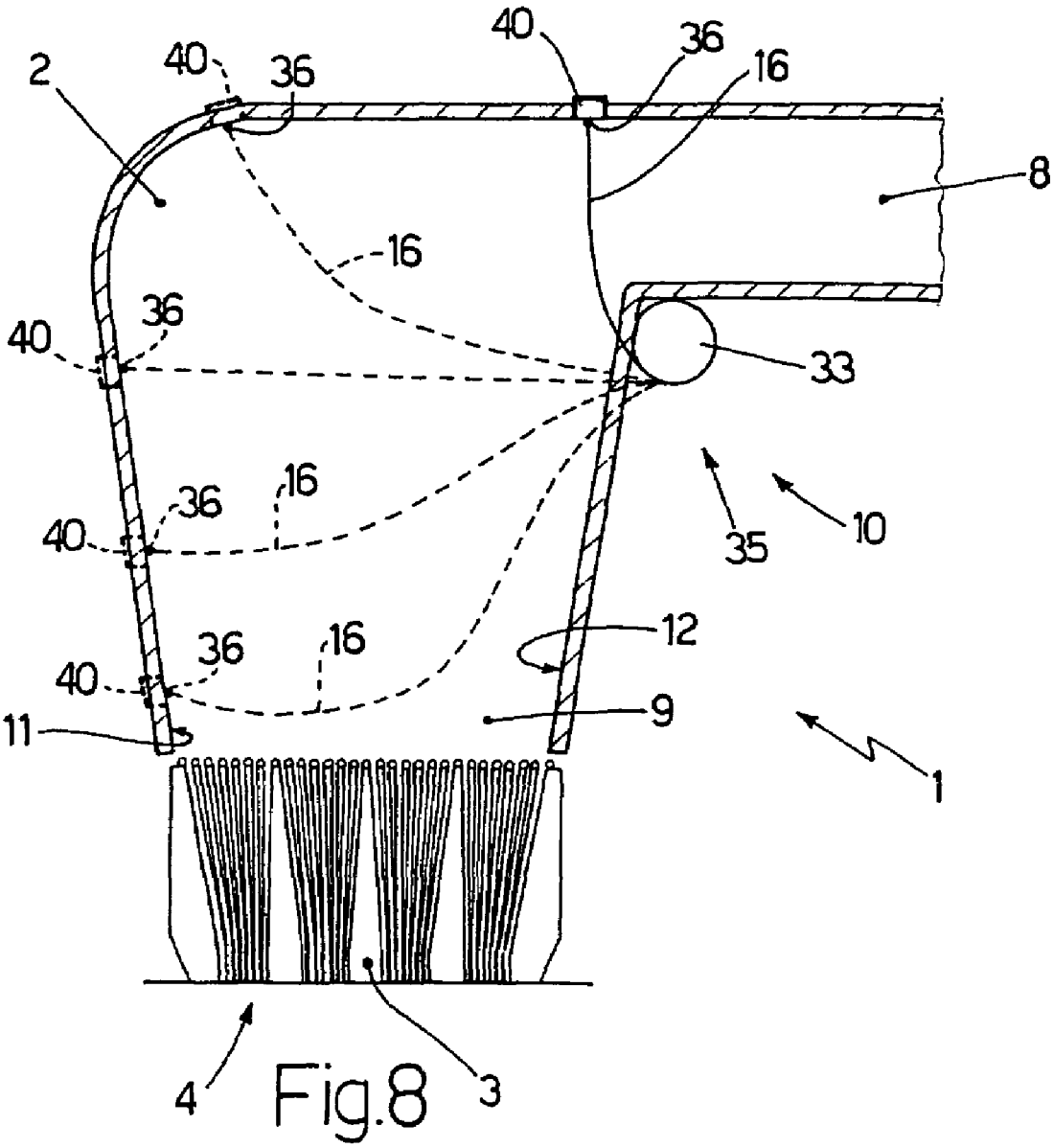

In the FIG. 8 embodiment, filling device 10 has only one flexible lead-in member 16 identical to lead-in member 16 described above. In actual use, end 36 of lead-in member 16 is fixed to a carriage 40 mounted to run along wall 11, and end 35 of lead-in member 16 is located inside reel 33, close to wall 12. As the length of lead-in member 16 inside channel 9 is gradually increased by unwinding reel 33, end 35 of lead-in member 16 is maintained in a fixed position, while end 36 of lead-in member 16 is moved along wall 11 by moving carriage 40. The change in the position of end 36 of lead-in member 16 along wall 11 reduces the overall length of lead-in member 16 and therefore also the size of reel 33.

Figure 9:
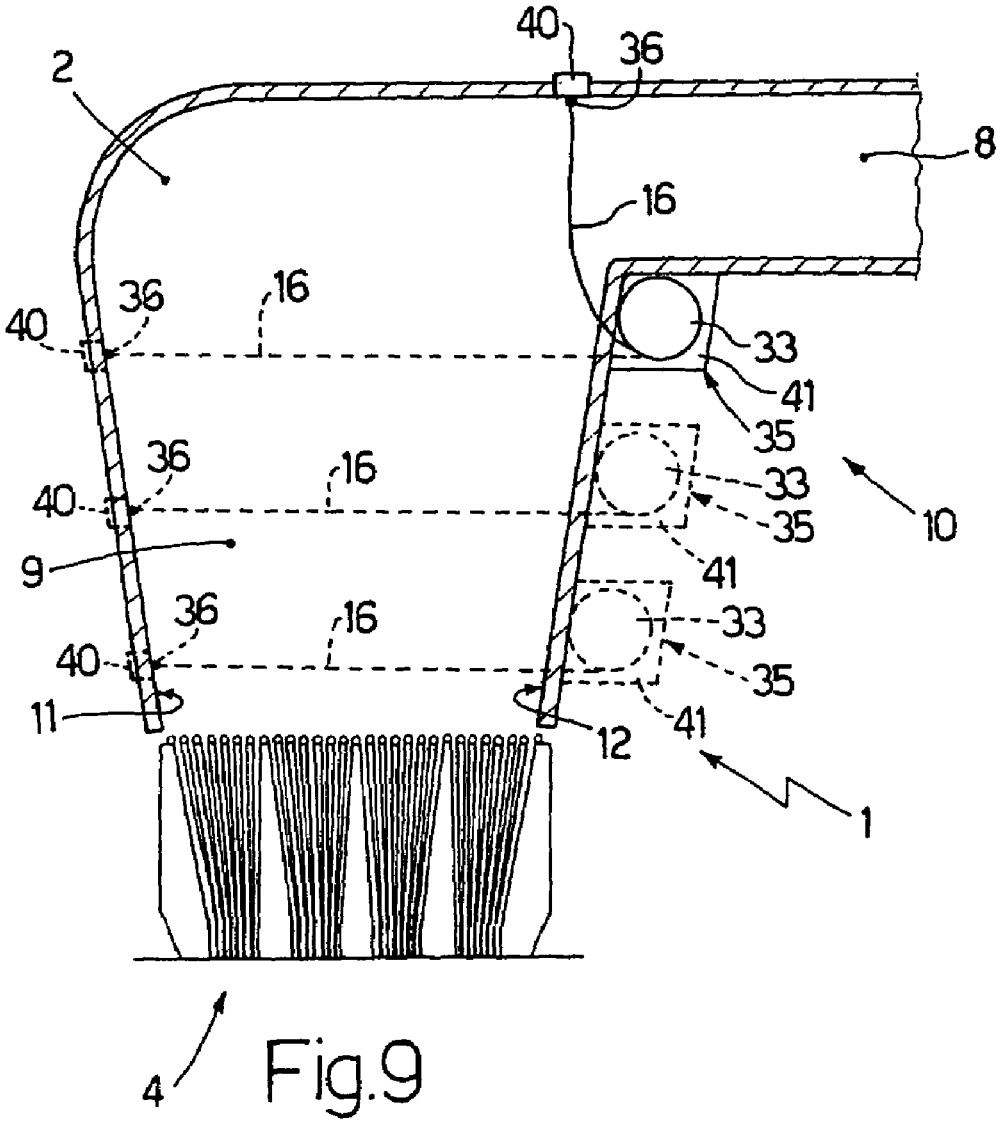

In the FIG. 9 embodiment, filling device 10 has only one flexible lead-in member 16 identical to lead-in member 16 described above. In actual use, end 36 of lead-in member 16 is fixed to a carriage 40 mounted to run along wall 11, and end 35 of lead-in member 16 is located inside reel 33, close to wall 12. Reel 33 is supported on a carriage 41 mounted to run along wall 12. As the length of lead-in member 16 inside channel 9 is gradually increased by unwinding reel 33, end 35 of lead-in member 16 is moved along wall 12 by moving carriage 41, while end 36 of lead-in member 16 is moved along wall 11 by moving carriage 40. The change in the position of end 35 of lead-in member 16 along wall 12, and in the position of end 36 of lead-in member 16 along wall 11, reduces the overall length of lead-in member 16 and therefore also the size of reel 33.

In the FIGS. 8 and 9 embodiments, lead-in member 16 may be flexible and elastically deformable to take up any variation in length produced by variations in the distance between end 36 contacting wall 11 and end 35 close to wall 12. Alternatively, lead-in member 16 may be non-deformable and of such a length as to take up, without deformation, any variation in length produced by variations in the distance between end 36 contacting wall 11 and end 35 close to wall 12.

In an alternative embodiment not shown, top chamber 2 comprises one vertical channel 9, and hopper 1 comprises one filling device 10 comprising a single rigid, non-deformable lead-in member 15 identical to lead-in member 15 described above.

Figure 10:
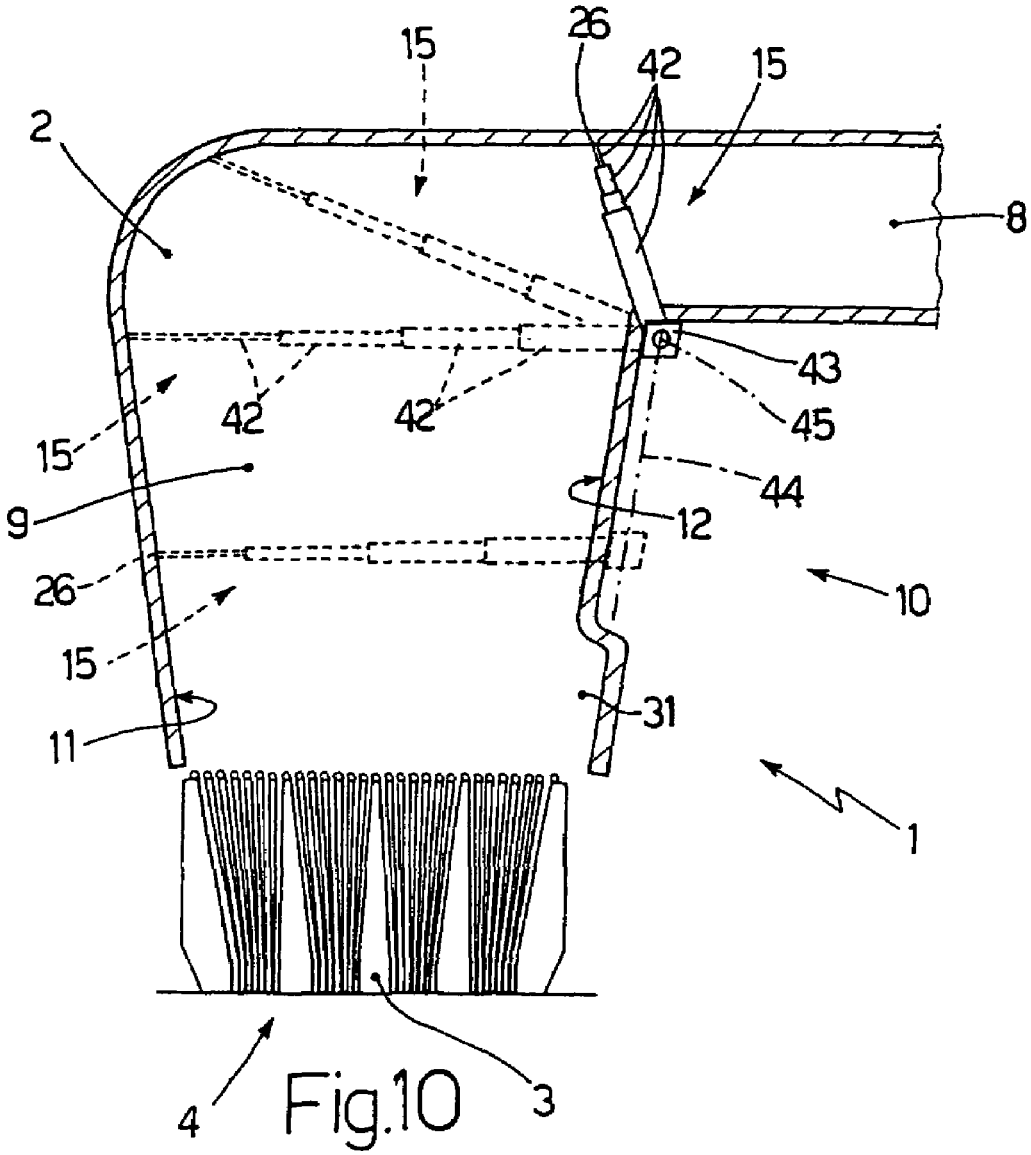

In the FIG. 10 embodiment, filling device 10 has a single rigid, telescopic lead-in member 15 comprising a number of rigid, non-deformable bodies 42 movable between a withdrawn position, in which bodies 42 are nested one inside another, and an extended position, in which bodies 42 are arranged in line with one another. Telescopic lead-in member 15 is preferably mounted on a carriage 43 running along a guide 44 parallel to wall 12, and is mounted on carriage 43 to rotate about an axis 45 perpendicular to the FIG. 10 plane. In actual use, telescopic lead-in member 15 is rotated about axis 45 and moved along wall 12, and is varied in length to keep end 26 contacting wall 11. In other words, end 26 of telescopic lead-in member 15 is moved along wall 11, while end 23, opposite end 26, of telescopic lead-in member 15 is moved along wall 12, so that lead-in member 15 "sweeps" channel 9 of hopper 1 to permit gradual, controlled filling of hopper 1. At the end of the filling operation, telescopic lead-in member 15 is rotated further about axis 45 into seat 31 formed along wall 12.

The above method and device 10 for controlled filling of hopper 1 have various advantages, by being cheap and easy to implement and permitting fast, automatic filling of hopper 1. Moreover, as hopper 1 is being filled, cigarettes 7 undergo no harmful mechanical stress, by being fed gradually and in controlled manner along hopper 1 at all times. Hopper 1 may also be filled in controlled manner with a new brand of cigarettes 7 and cleared of the previous brand of cigarettes 7 simultaneously, thus reducing the downtime involved in preparing the packing machine to pack the new brand of cigarettes 7. Finally, it is important to note that each lead-in member 15 and each lead-in member 16 are kept inside channel 9 at all times, and, at the end of the filling operation, are positioned contacting one of walls 11 and 12 bounding channel 9.

Given the numerous advantages involved, the method and device 10 described may be used for controlled filling of any type of channel 9 supplying cigarettes 7 or other tobacco articles (e.g. portions of filter material or cigars).

The invention claimed is:

1. A method for controlled filling of a channel (9) supplying tobacco articles (7), which channel (9) is bounded laterally by a first wall (11) and a second wall (12) opposite and facing each other, the method comprising the steps of:

positioning a flexible lead-in member (16) inside the channel (9) to completely cut off passage along the channel (9) so as a first end (36) of the lead-in member (16) is located at the first wall (11) and a second end (35) of the lead-in member (16) is located at the second wall (12);

feeding a mass of tobacco articles (7) into the channel (9), so that the mass of tobacco articles (7) is positioned contacting the lead-in member (16);

easing the lead-in member (16) along the channel (9), while keeping the mass of tobacco articles (7) in contact with the lead-in member (16), to ease the mass of tobacco articles (7) along the channel (9), the lead-in member (16) changing in configuration as the mass of tobacco articles (7) is eased along the channel (9); and moving the first end (36) of the lead-in member (16) along the first wall (11) while the lead-in member (16) is eased along the channel (9), wherein the channel (9) supplying tobacco articles (7) is divided into a first portion which is filled gradually by a rigid, non-deformable first lead-in member (15) eased along the channel (9) substantially in contact with the inner surfaces of the walls (11, 12) bounding the channel (9); and into a second portion which is filled gradually by a flexible second lead-in member (16) wound into a reel (33) about a pin (34) fitted to the first lead-in member (15).

2. A method as claimed in claim 1, wherein the lead-in member (16) is flexible and elastically deformable to take up any variation in length produced by variations in the distance between the first end (36) contacting the first wall (11) and the second end (35) contacting the second wall (12).

3. A method as claimed in claim 1, wherein, to ease the mass of tobacco articles (7) along the channel (9), the length of the lead-in member (16) inside the channel (9) is gradually increased; consequently, as the mass of tobacco articles (7) is eased along the channel (9), the lead-in member (16) defines, between the first end (36) and the second end (35), a flexible bag containing the mass of tobacco articles (7), and which increases gradually in size and rests on the walls (11, 12) bounding the channel (9).

4. A method as claimed in claim 3, wherein at the second end (35) the lead-in member (16) is wound into a reel (33) about a central pin (34).

5. A method as claimed in claim 4, wherein the length of the lead-in member (16) is increased gradually through an opening formed through the second wall (12).

6. A method as claimed in claim 4, wherein, at the end of the filling operation, the first end (36) of the lead-in member (16) is detached from the first wall (11), and the lead-in member (16) is withdrawn gradually from the channel (9) by rewinding the reel (33).

7. A method as claimed in claim 6, wherein, at the end of the filling operation, the first end (36) of the lead-in member (16) is located inside a seat (39) formed in the second wall (12), so that an outer surface of the first end (36) is coplanar with a surface of the second wall (12).

8. A method as claimed in claim 1, wherein the channel (9) supplying tobacco articles (7) is divided into a number of successive portions which are filled successively by respective lead-in members (15; 16).

9. A method as claimed in claim 1, wherein the first lead-in member (15) is larger than the distance between the first wall (11) and the second wall (12), and is therefore tilted to form non-right-angles with the first wall (11) and the second wall (12).

10. A method as claimed in claim 9, wherein a first end (23) of the first lead-in member (15) is moved in contact with the first wall (11), and a second end (26) of the first lead-in member (15) is pushed with a given elastic force against the second wall (12).

11. A method as claimed in claim 10, wherein the second end (26) of the first lead-in member (15) mechanically engages a catch member (30) located on the second wall (12) to insert the first lead-in member (15) inside a seat (31) formed in the second wall (12).

12. A method as claimed in claim 11, wherein, just before the second end (26) of the first lead-in member (15) mechanically engages the catch member (30), a first end (36) of the second lead-in member (16) is fixed to the first wall (11), and a second end (35) of the second lead-in member (16) is maintained close to the second wall (12) together with the first lead-in member (15); and, to ease the mass of tobacco articles (7) along the channel (9), the length of the second lead-in member (16) inside the channel (9) is gradually increased; consequently, as the mass of tobacco articles (7) is eased along the channel (9), the second lead-in member (16) defines, between the first end (36) and the second end (35), a flexible bag containing the mass of tobacco articles (7) and resting on the walls (11, 12) bounding the channel (9).

13. A method as claimed in claim 12, wherein, at the end of the filling operation, the first end (36) of the second lead-in member (16) is detached from the first wall (11), and the second lead-in member (16) is gradually withdrawn from the channel (9).

14. A method as claimed in claim 1, wherein the channel (9) supplying tobacco articles (7) is divided into two specular halves filled simultaneously by respective lead-in members.

15. A method for controlled filling of a channel (9) supplying tobacco articles (7), which channel (9) is bounded laterally by a first wall (11) and a second wall (12) opposite and facing each other, the method comprising the steps of positioning a lead-in member (15; 16) inside the channel (9) to completely cut off passage along the channel (9), the lead-in member (15; 16) being rigid and non-deformable, and being eased along the channel (9) substantially in contact with the inner surfaces of the walls (11, 12) bounding the channel (9);

feeding a mass of tobacco articles (7) into the channel (9), so that the mass of tobacco articles (7) is positioned contacting the lead-in member (15; 16);

easing the lead-in member (15; 16) along the channel (9), while keeping the mass of tobacco articles (7) in contact with the lead-in member (15; 16), to ease the mass of tobacco articles (7) along the channel (9);

keeping the lead-in member (15; 16) inside the channel (9) at all times during the filling operation; and positioning, at the end of the filling operation, the lead-in member (15; 16) contacting one of the walls (11, 12) bounding the channel (9) by locating lead-in member (15; 16) inside a seat (31; 39) formed in one of the walls (11; 12) bounding the channel (9), so that an outer surface (32) of the lead-in member (15; 16) is coplanar with a surface of the wall (12) bounding the channel (9).

16. A method for controlled filling of a channel (9) supplying tobacco articles (7), which channel (9) is bounded laterally by a first wall (11) and a second wall (12) opposite and facing each other, the method comprising the steps of:

positioning a lead-in member (15; 16) inside the channel (9) to completely cut off passage along the channel (9);

feeding a mass of tobacco articles (7) into the channel (9), so that the mass of tobacco articles (7) is positioned contacting the lead-in member (15; 16);

easing the lead-in member (15; 16) along the channel (9), while keeping the mass of tobacco articles (7) in contact with the lead-in member (15; 16), to ease the mass of tobacco articles (7) along the channel (9); and dividing the channel (9) into a number of successive portions filled successively by respective lead-in members (15; 16).

17. A method for controlled filling of a channel (9) supplying tobacco articles (7), which channel (9) is bounded laterally by a first wall (11) and a second wall (12) opposite and facing each other, the method comprising the steps of:

positioning a lead-in member (15) inside the channel (9) to completely cut off passage along the channel (9), the lead-in member (15) being rigid and non-deformable, and being eased along the channel (9) substantially in contact with the inner surfaces of the walls (11, 12) bounding the channel (9);

feeding a mass of tobacco articles (7) into the channel (9), so that the mass of tobacco articles (7) is positioned contacting the lead-in member (15); and easing the lead-in member (15) along the channel (9), while keeping the mass of tobacco articles (7) in contact with the lead-in member (15), to ease the mass of tobacco articles (7) along the channel (9), wherein the lead-in member (15) is larger than the distance between the first wall (11) and the second wall (12), and is therefore tilted to form non-right-angles with the first wall (11) and the second wall (12), wherein a first end (23) of the lead-in member (15) is moved in contact with the first wall (11), and a second end (26) of the lead-in member (15) is pushed with a given elastic force against the second wall (12), and.

wherein, at the end of the filling operation, the lead-in member (15) is positioned contacting the second wall (12) and inside a seat (31) formed in the second wall (12), so that an outer surface (32) of the lead-in member (15) is coplanar with a surface of the second wall (12).

18. A method as claimed in claim 17, wherein, at the end of the filling operation, at least part of the second end (26) of the lead-in member (15) mechanically engages a catch member (30) located on the second wall (12), immediately upstream from the seat (31).

19. A device (10) for controlled filling of a channel (9) supplying tobacco articles (7), which channel (9) is bounded laterally by a first wall (11) and a second wall (12) opposite and facing each other, the device (10) comprising:

a flexible lead-in member (16) which is positioned inside the channel (9) so as a first end (36) of the lead-in member (16) is located close to the first wall (11), and a second end (35) of the lead-in member (16) is located close to the second wall (12); and actuating means for positioning the lead-in member (16) inside the channel (9) to completely cut off passage along the channel (9) and to intercept a mass of tobacco articles (7) fed into the channel (9), and for subsequently easing the lead-in member (16) along the channel (9), while keeping the mass of tobacco articles (7) in contact with the lead-in member (16), to ease the mass of tobacco articles (7) along the channel (9), the lead-in member (16) changing in configuration as the mass of tobacco articles (7) is eased along the channel (9), wherein the actuating means move the first end (36) of the lead-in member (16) along the first wall (11), wherein the channel (9) supplying tobacco articles (7) is divided into a first portion, and a second portion located downstream from the first portion; there are provided a rigid, non-deformable first lead-in member (15), and first actuating means (17) for easing the first lead-in member (15) along the first portion of the channel (9), substantially in contact with the inner surfaces of the walls (11, 12) bounding the channel (9); and there are provided a flexible second lead-in member (16) wound into a reel (33) about a pin (34) fitted to the first lead-in member (15), and second actuating means (37) for moving the second lead-in member (16) along the second portion of the channel (9).

20. A device (10) as claimed in claim 19, wherein the lead-in member (16) is flexible and elastically deformable to take up any variation in length produced by variations in the distance between the first end (36) contacting the first wall (11) and the second end (35) contacting the second wall (12).

21. A device (10) as claimed in claim 19, wherein the actuating means gradually increase the length of the lead-in member (16) inside the channel (9) to ease the mass of tobacco articles (7) along the channel (9); consequently, as the mass of tobacco articles (7) is eased along the channel (9), the lead-in member (16) defines, between the first end (36) and the second end (35), a flexible bag containing the mass of tobacco articles (7), and which increases gradually in size and rests on the walls (11, 12) bounding the channel (9).

22. A device (10) as claimed in claim 19, wherein the actuating means comprise a powered pin (34) located at the second end (35) and about which the lead-in member (16) is wound into a reel (33).

23. A device (10) as claimed in claim 19, wherein the first lead-in member (15) is larger than the distance between the first wall (11) and the second wall (12), and is therefore tilted to form non-right-angles with the first wall (11) and the second wall (12).

24. A device (10) as claimed in claim 23, wherein the first actuating means (17) comprise a guide (18) extending parallel to the channel (9) and outside the channel (9); a carriage (19) which runs along the guide (18); and a rigid arm (20) having a first end (21) connected to the carriage (19), and an opposite second end (22) to which a first end (23) of the first lead-in member (15) is hinged to rotate freely about an axis (24) of rotation; the first end (21) of the arm (20) is maintained close to the first wall (11) of the channel (9); and the arm (20) supports an elastic member (25) which pushes a second end (26) of the first lead-in member (15) against the second wall (12) of the channel (9) with a given elastic force.

25. A device (10) as claimed in claim 24, wherein the first end (21) of the arm (20) is hinged to the carriage (19) to rotate under the control of a tappet roller (27) connected to a cam (28).

26. A device (10) as claimed in claim 24, wherein the second wall (12) has a catch member (30), and a seat (31) located immediately downstream from the catch member (30); and the second end (26) of the first lead-in member (15) mechanically engages the catch member (30) to insert the first lead-in member (15) inside the seat (31).

27. A device (10) as claimed in claim 26, wherein the second actuating means (37) comprise a motor (38) connectable to the pin (34) to rotate the pin (34) to wind or unwind the reel (33).

28. A device (10) as claimed in claim 27, wherein the second actuating means (37) fix a first end (36) of the second lead-in member (16) to the first wall (11) just before the second end (26) of the first lead-in member (15) mechanically engages the catch member (30); the second actuating means (37) unwind the reel (33) to gradually increase the length of the second lead-in member (16) inside the channel (9) and so ease the mass of tobacco articles (7) along the channel (9); and, consequently, as the mass of tobacco articles (7) is eased along the channel (9), the second lead-in member (16) defines, between the first end (36) and the second end (35), a flexible bag containing the mass of tobacco articles (7) and resting on the walls (11, 12) bounding the channel (9).

29. A device (10) as claimed in claim 28, wherein, at the end of the filling operation, the second actuating means (37) detach the first end (36) of the second lead-in member (16) from the first wall (11), and rewind the reel (33) to gradually withdraw the second lead-in member (16) from the channel (9).

30. A device (10) as claimed in claim 19, wherein the channel (9) supplying tobacco articles (7) is divided into two specular halves filled simultaneously by respective lead-in members (15, 16).

31. A device (10) as claimed in claim 19, wherein the channel (9) supplying tobacco articles (7) slopes downwards, and the mass of tobacco articles (7) is maintained in contact with the lead-in member (15) by force of gravity.

32. A device (10) as claimed in claim 19, wherein the channel (9) defines the top chamber (2) of a hopper (1) for tobacco articles (7).

33. A device (10) as claimed in claim 32, wherein the hopper (1) has a bottom chamber (3), in which are defined a number of outlets (4) from which to expel groups of tobacco articles (7).

34. A device (10) for controlled filling of a channel (9) supplying tobacco articles (7), which channel (9) is bounded laterally by a first wall (11) and a second wall (12) opposite and facing each other, the device (10) comprising:

a lead-in member (15; 16) which is positioned inside the channel (9); and actuating means for positioning the lead-in member (15; 16) inside the channel (9) to completely cut off passage along the channel (9) and to intercept a mass of tobacco articles (7) fed into the channel (9), and for subsequently easing the lead-in member (15; 16) along the channel (9), while keeping the mass of tobacco articles (7) in contact with the lead-in member (15; 16), to ease the mass of tobacco articles (7) along the channel (9), wherein the lead-in member (15; 16) is maintained inside the channel (9) at all times, and, at the end of the filling operation, is positioned contacting one of the walls (11, 12) bounding the channel (9), and wherein a seat (31; 39) is formed in the second wall (12) to house the lead-in member (15; 16) at the end of the filling operation, so that an outer surface (32) of the lead-in member (15; 16) is coplanar with a surface of the second wall (12).

35. A device (10) for controlled filling of a channel (9) supplying tobacco articles (7), which channel (9) is bounded laterally by a first wall (11) and a second wall (12) opposite and facing each other, the device (10) comprising:

a lead-in member (15; 16) which is positioned inside the channel (9); and actuating means for positioning the lead-in member (15; 16) inside the channel (9) to completely cut off passage along the channel (9) and to intercept a mass of tobacco articles (7) fed into the channel (9), and for subsequently easing the lead-in member (15; 16) along the channel (9), while keeping the mass of tobacco articles (7) in contact with the lead-in member (15; 16), to ease the mass of tobacco articles (7) along the channel (9), wherein the channel (9) supplying tobacco articles (7) is divided into a number of successive portions filled successively by respective lead-in members (15; 16).

36. A method for controlled filling of a channel (9) supplying tobacco articles (7), which channel (9) is bounded laterally by a first wall (11) and a second wall (12) opposite and facing each other, the method comprising the steps of:

positioning a flexible lead-in member (16) inside the channel (9) to completely cut off passage along the channel (9) so as a first end (36) of the lead-in member (16) is located at the first wall (11) and a second end (35) of the lead-in member (16) is located at the second wall (12);

feeding a mass of tobacco articles (7) into the channel (9), so that the mass of tobacco articles (7) is positioned contacting the lead-in member (16);

easing the lead-in member (16) along the channel (9), while keeping the mass of tobacco articles (7) in contact with the lead-in member (16), to ease the mass of tobacco articles (7) along the channel (9); the lead-in member (16) changes in configuration as the mass of tobacco articles (7)is eased along the channel (9); and moving the first end (36) of the lead-in member (16) along the first wall (11) while the lead-in member (16) is eased along the channel (9), wherein, to ease the mass of tobacco articles (7) along the channel (9), the length of the lead-in member (16) inside the channel (9) is gradually increased; consequently, as the mass of tobacco articles (7) is eased along the channel (9), the lead-in member (16) defines, between the first end (36) and the second end (35), a flexible bag containing the mass of tobacco articles (7), and which increases gradually in size and rests on the walls (11, 12) bounding the channel (9), and wherein at the second end (35) the lead-in member (16) is wound into a reel (33) about a central pin (34).

37. A method as claimed in claim 36, wherein the length of the lead-in member (16) is increased gradually through an opening formed through the second wall (12).

38. A method as claimed in claim 36, wherein, at the end of the filling operation, the first end (36) of the lead-in member (16) is detached from the first wall (11), and the lead-in member (16) is withdrawn gradually from the channel (9) by rewinding the reel (33).

39. A method as claimed in claim 38, wherein, at the end of the filling operation, the first end (36) of the lead-in member (16) is located inside a seat (39) formed in the second wall (12), so that an outer surface of the first end (36) is coplanar with a surface of the second wall (12).

40. A method for controlled filling of a channel (9) supplying tobacco articles (7), which channel (9) is bounded laterally by a first wall (11) and a second wall (12) opposite and facing each other, the method comprising the steps of:

positioning a flexible lead-in member (16) inside the channel (9) to completely cut off passage along the channel (9) so as a first end (36) of the lead-in member (16) is located at the first wall (11) and a second end (35) of the lead-in member (16) is located at the second wall (12);

feeding a mass of tobacco articles (7) into the channel (9), so that the mass of tobacco articles (7) is positioned contacting the lead-in member (16);

easing the lead-in member (16) along the channel (9), while keeping the mass of tobacco articles (7) in contact with the lead-in member (16), to ease the mass of tobacco articles (7) along the channel (9); the lead-in member (16) changes in configuration as the mass of tobacco articles (7) is eased along the channel (9); and moving the first end (36) of the lead-in member (16) along the first wall (11) while the lead-in member (16) is eased along the channel (9), wherein the channel (9) supplying tobacco articles (7) is divided into two specular halves filled simultaneously by respective lead-in members.

41. A device (10) for controlled filling of a channel (9) supplying tobacco articles (7), which channel (9) is bounded laterally by a first wall (11) and a second wall (12) opposite and facing each other, the device (10) comprising:

a flexible lead-in member (16) which is positioned inside the channel (9) so as a first end (36) of the lead-in member (16) is located close to the first wall (11), and a second end (35) of the lead-in member (16) is located close to the second wall (12); and actuating means for positioning the lead-in member (16) inside the channel (9) to completely cut off passage along the channel (9) and to intercept a mass of tobacco articles (7) fed into the channel (9), and for subsequently easing the lead-in member (16) along the channel (9), while keeping the mass of tobacco articles (7) in contact with the lead-in member (16), to ease the mass of tobacco articles (7) along the channel (9); the lead-in member (16) changes in configuration as the mass of tobacco articles (7) is eased along the channel (9), wherein the actuating means move the first end (36) of the lead-in member (16) along the first wall (11), and wherein the actuating means comprise a powered pin (34) located at the second end (35) and about which the lead-in member (16) is wound into a reel (33).

* * * * *